US007002120B2

(12) United States Patent
Cherry

(10) Patent No.: US 7,002,120 B2
(45) **Date of Patent: *Feb. 21, 2006**

(54) MICROWAVE OVEN CLEANER

(76) Inventor: John-Paul Francis Cherry, 3203 Oak Bough La., Missouri City, TX (US) 77459-4655

( * ) Notice: Subject to any disclaimer, the term of this patent is extended or adjusted under 35 U.S.C. 154(b) by 0 days.

This patent is subject to a terminal disclaimer.

(21) Appl. No.: 10/999,284

(22) Filed: Nov. 30, 2004

(65) Prior Publication Data

US 2005/0092744 A1 May 5, 2005

Related U.S. Application Data

(63) Continuation of application No. 10/701,336, filed on Nov. 4, 2003, now Pat. No. 6,875,967, which is a continuation of application No. 09/923,511, filed on Aug. 7, 2001, now Pat. No. 6,656,288.

(60) Provisional application No. 60/225,709, filed on Aug. 16, 2000.

(51) Int. Cl.
*H05B 6/64* (2006.01)

(52) U.S. Cl. ..... 219/678; 134/1

(58) Field of Classification Search ..... 219/678; 134/1, 11, 12, 2, 17, 31, 105, 34–35, 96.1; 422/1, 21; 428/34, 2; 229/5.81, 903
See application file for complete search history.

(56) References Cited

U.S. PATENT DOCUMENTS

| | | | |
|---|---|---|---|
| 3,753,651 | A | 8/1973 | Boucher |
| 4,481,395 | A | 11/1984 | Smith et al. |
| 4,560,850 | A | 12/1985 | Levendusky et al. |
| 4,633,052 | A | 12/1986 | Beavers et al. |
| 4,721,140 | A | 1/1988 | Coker |
| 4,778,968 | A | 10/1988 | Torres |
| 4,861,956 | A | 8/1989 | Courneya |
| 5,007,529 | A | 4/1991 | Spector |
| 5,290,985 | A | 3/1994 | Jancic et al. |
| 5,313,878 | A | 5/1994 | Strait |
| 5,425,972 | A | 6/1995 | Calvert |
| 5,432,324 | A | 7/1995 | Freewald |
| 5,436,434 | A | 7/1995 | Baird |
| 5,558,798 | A | 9/1996 | Tsai |
| 6,322,748 | B1 | 11/2001 | Hutton et al. |

(Continued)

FOREIGN PATENT DOCUMENTS

| | | | |
|---|---|---|---|
| DE | 3937720 | A1 | 5/1991 |

(Continued)

OTHER PUBLICATIONS

Greer, B., Agricultural Extension service, University of Tennessee-Jan. 1999.

(Continued)

*Primary Examiner*—Quang Van

(57) ABSTRACT

A device and method that cleans microwave ovens through a chemical action, specifically to an agent that is placed into the microwave oven, and then activated by operating the oven for a period of time. Different embodiments include a device composed of an open cell container filled with solution; an open cell container with an attached sponge(s) and filled with solution; and a sponge that contains a cleaning solution in hydrant or dehydrated form. In some of the described embodiments, the device has a tear off membrane seal to maintain the solution within the cell prior to use. Another embodiment described has a bottle hanger attached to a cell. All embodiments maintain a process to absorb excess microwave energy.

29 Claims, 3 Drawing Sheets

U.S. PATENT DOCUMENTS

| | | | |
|---|---|---|---|
| 6,444,963 | B1 | 9/2002 | Donahue |
| 6,656,288 | B1 | 12/2003 | Cherry |
| 6,878,910 | B1 | 4/2005 | Kim et al. |
| 2002/0113067 | A1 | 8/2002 | Donahue |
| 2002/0176794 | A1 | 11/2002 | Donahue |

FOREIGN PATENT DOCUMENTS

| | | | | |
|---|---|---|---|---|
| DE | 4008919 | A1 | | 9/1991 |
| EP | 0428024 | A2 | | 5/1991 |
| JP | 10-229963 | A | | 9/1998 |
| JP | 10-316177 | | | 12/1998 |
| JP | 10314092 | A | * | 12/1998 |
| JP | H10-314092 | | | 12/1998 |
| JP | 2000-082580 | | | 3/2000 |
| JP | 2000-085854 | A | | 3/2000 |
| JP | 2000082580 | A | * | 3/2000 |
| JP | 2000-126700 | | | 5/2000 |
| JP | 2004170053 | | | 6/2004 |
| KR | 118075 | Y | | 4/1998 |
| WO | WO 98/03622 | A2 | | 1/1998 |

OTHER PUBLICATIONS http://homeparents.about.com/c/ht/00/07/How__Clean__Microwave__Oven0962934268. htm—not dated.

http://www.mouthshut.com/readreview/10138-1.html—May 2001.

Easy-Off Heat Activated Microwave Wipes press release—Sep. 4, 2002.

Easy-Off Heat-Activated Microwave Wipes advertisement—Sep. 14, 2002.

http://www.easyoff.us/whatsnew.shtml—Aug. 27, 2004.

http://www.cadie.com/sponge__microwave__.html—Jul. 2005.

* cited by examiner

MICROWAVE OVEN CLEANER

CROSS-REFERENCE TO RELATED APPLICATIONS

This application is a continuation of U.S. patent application Ser. No. 10/701,336, filed Nov. 4, 2003, now U.S. Pat. No. 6,875,967 which is a continuation of U.S. patent application Ser. No. 09/923,511, now U.S. Pat. No. 6,656,288, filed Aug. 7, 2001, which claims benefit of U.S. Provisional Patent Application No. 60/225,709, filed Aug. 16, 2000. Each of the aforementioned related patent applications is herein incorporated by reference.

BACKGROUND OF THE INVENTION

Food residue is often found coating the inside of microwave ovens, especially industrial, commercial and educational settings. Over time, the accumulation of the food produces an unsightly mess that is also difficult to clean, as the material is repeatedly dehydrated to aggressively adhere to the surface. Attempts to scrub away the particulate by conventional method (i.e., abrasive sponge with soap and water) are time-consuming and may damage the plastic walls of the microwave. The process is also difficult because the worse part of the mess is often on the top of the oven, the area that is the hardest to see and clean. While microwave ovens have become symbolic of being quick and easy to use, the same is not true of cleaning them.

This problem has been noticed and several patents have been issued applying alternative solutions.

PRIOR ART

Several patents have been issued to address this problem. U.S. Pat. Nos. 4,481,395 and 5,290,985 keep the walls of the microwave oven clean by placing inserts into the oven, relying on conventional cleaning methods (washing, scrubbing, drying) to be used when the insert is removed. A dishwasher may be used, if one is around. Also, these devices consume some of the usable volume inside the oven.

In U.S. Pat. Nos. 4,633,052 and 4,778,968, non-flammable, pre-sized paper is used to cover the floor of microwave oven. Once the paper becomes soiled, it is thrown out and replaced with a new sheet. Though these patents protect the floor, the walls and ceiling are overlooked. The ceiling generally accumulates the majority of the food debris while being the more difficult area to clean.

Furthermore, each of the above-mentioned patents necessitate the device to be custom-dimensioned (in as many as three axes) for use in each different size of microwave oven. This represents a significant limitation.

Other inventions have realized this problem of soiling a microwave oven and have attempted preventive solutions. These inventions, such as U.S. Pat. Nos. 4,721,140 and 5,436,434, use splatter guards to minimize the expulsion of food material onto the inner surfaces of the oven.

U.S. Pat. Nos. 4,560,850, 5,313,878, 5,432,324 and 5,558,798 have been issued for releasing steam or moisture for the use of cooking or steaming food. Also, U.S. Pat. Nos. 3,753,651 and 4,861,956 address the sterilization of surfaces, of items brought into the oven, by the use of microwave radiation and/or steam. All of the above mentioned patents ignore cleaning the interior of the microwave oven.

It is therefore desirable to have a simple, quick, low-cost means of cleaning a microwave oven that saves effort to clean the oven while not disturbing normal microwave activities. Moreover, the power of the oven should be utilized to clean itself. The device should not require customization or resizing to work in different sizes of microwave ovens. All materials should be non-toxic, so any residues would not pose a threat to health.

SUMMARY OF THE INVENTION

The instant invention is a cleaning device consisting (in its simplest form) of an open cell container used to hold a non-toxic, aqueous solution that may contain surfactant(s) such as TERGITOL® 15-S-9, d-limonene and/or an emulsifier such as ethoxylated-soybean oil. Details are provided below. The method of use is to place the device into the microwave oven that is then turned on for approximately five minutes, followed by a period of an additional five minutes while the oven door remains closed, allowing the solution to penetrate the caked-on material. The door is then opened. Food residues, which previously held aggressively to the interior of the oven, may be thoroughly wiped clean with a soft sponge or towel. Many residues fall off. The invention works impressively well.

There are four factors to the efficaciousness of the invention: 1) the vapor phase of the solution, created by heating with microwave energy, has a direct effect of softening the residue by steaming; 2) the surfactant is borne by the vapor phase of the solution to the residue at any location in the oven, where it bonds to any remaining oils; 3) the "cool-down" period allows the solution to leave the vapor phase, condense and penetrate more deeply into the residue, also carrying surfactant deeper inside; 4) the wiping down phase, in which the heated solution remaining in the device is used to wipe down the surfaces of the oven. During the vapor phase, any fragrance or scent is distributed throughout the room in which the oven resides. The result is a highly efficacious, low cost, non-toxic, microwave oven cleaning method. The volume of solution used for a cleaning must be sufficiently small so that it will boil for a predominance of the on-time of the oven (during cleaning), in the range of 80–100 mL. The volume of the solution must be in accord to the cooking time and concentration of surfactant. Though some of the surfactant will be borne onto the interior surfaces of the oven, much will remain dissolved in the solution of the reservoir. The surfactant will slow the loss of water in the reservoir; therefore, maintaining a protective material for excess microwave energy.

In the solution, the proposed surfactants are non-toxic, making the invention completely safe in the event any residues are left after the cleaning process. Scent such as lemon or pine may be added to produce a pleasant smell. Antibacterial compound may be added without degrading the effectiveness of the process.

Several embodiments are disclosed for an open-cell container including: a simple dispenser with a tear-off membrane seal; a sponge that is soaked with solution; an integrated dispenser and sponge with a tear-off cover; an integrated dispenser and sponge in which the solution is released by penetrating the sponge; a dispenser with a fill line and sponge; and a dispenser with an attached bottle hanger and sponge.

DETAILED DESCRIPTION OF THE DRAWINGS

Figure 1:
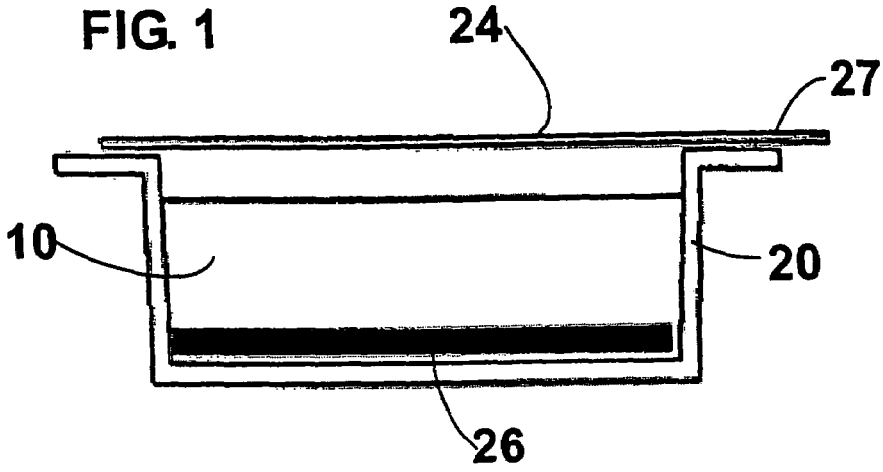
FIG. 1 shows a section through a microwave oven cleaner device made of a dispenser with a tear-off membrane seal containing the cleaning solution.

FIG. 1 shows the solution 10 in a disposable dispenser 20 with a tear-off membrane seal 24. To open, tear tab 27. A gelatinous material 26 prevents damage to the microwave if solution 10 is boiled away well before heating cycle ends, preventing damage to the oven.

The dispenser 20 with tear-off membrane seal 24 maintains solution 10 until time of use. Once the seal 24 is pierced or removed, the apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the interior surfaces of the oven with a sponge, cloth, paper towel, shammy or similar item.

The preferred solution for this embodiment contains approximately, by volume, 96% water, 2% d-limonene and 2% E-Z-MULSE®, an ethoxylated soybean-oil emulsifier (ingredients available from Florida Chemical Co.). d-Limonene is a non-toxic, citrus scent that also enhances performance due to its surfactant properties. Another embodiment uses a blend surfactant, such as a 1% solution containing 40% TERGITOL® 15-S-9 and 60% TERGITOL® 15-S-15, (available from Union Carbide) in an aqueous base. Emulsifiers may be used to aid surfactants while dissolving in the aqueous solution. A non-blend embodiment uses TRITON® X301, also from Union Carbide. Antibacterial agents, such as triclosan, or other additives, such as ammonia, are also obvious to include as an option. Surfactant concentrations in the range of 0.5% to 50% are also obvious to include as an option.

While a microwave oven operates, substances containing water, generally food, absorb microwave energy. Excess microwave energy will destroy a microwave oven. Concentration of dissolved surfactant may be altered such to slow the rate of evaporation of solution 10 and allow the absorption of excess microwave energy. The gelatinous material 26 also absorbs excess energy and may be used with solution 10 to curtail dehydration of solution 10. The collaborative effort of solution 10 and the gelatinous material 26 produces a larger, therefore safer, interval to operate and clean the oven than solution 10 alone.

The dispenser 20 could be made from a variety of materials including plastic, paper, cardboard, glass, ceramic or other microwave-safe materials.

Figure 2:
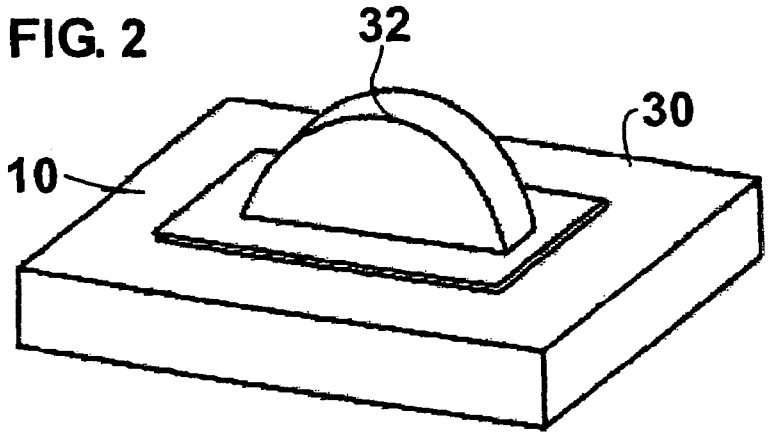
FIG. 2 shows a microwave oven cleaner device with the solution in a sponge.

FIG. 2 shows solution 10 soaked in a sponge 30 with a plastic handle 32 attached by prongs that penetrate the sponge 30. The sponge is packaged in such a way to prevent drying of the sponge 30 (i.e., plastic wrap found on traditional single wrapped sponges).

The sponge 30 would be removed from plastic wrap just prior to using and placed into the oven. The vapor phase has begun once the oven is started. During this phase, a portion of solution 10 will vaporize and leave the sponge 30. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by using the sponge 30, and the remaining heated solution 10 inside of sponge 30, to wipe off the interior surfaces of the oven. The device may also be produced with the surfactant in the sponge and sold in a dehydrated state, reducing weight to save on shipping cost. The product would be wetted prior to use. The handle 32 may be omitted.

Figure 3:
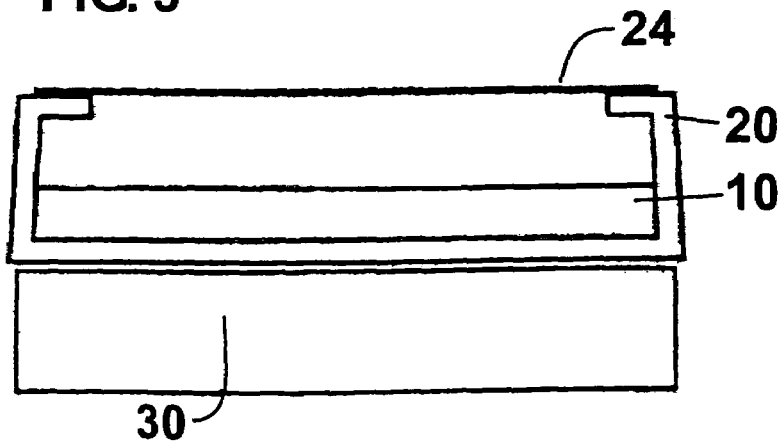
FIG. 3 shows a section through a microwave oven cleaner device including a dispenser with a tear-off membrane seal and an integral clean-up sponge.

FIG. 3 shows a disposable dispenser 20 with a tear-off membrane seal 24 containing the solution 10 and a sponge 30 integrated into the back of the dispenser 20.

The dispenser 20 with tear-off membrane seal 24 maintains solution 10 until time of use. Once the seal 24 is pierced or removed, the apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the interior surfaces of the oven with attached sponge 30.

Figure 4:
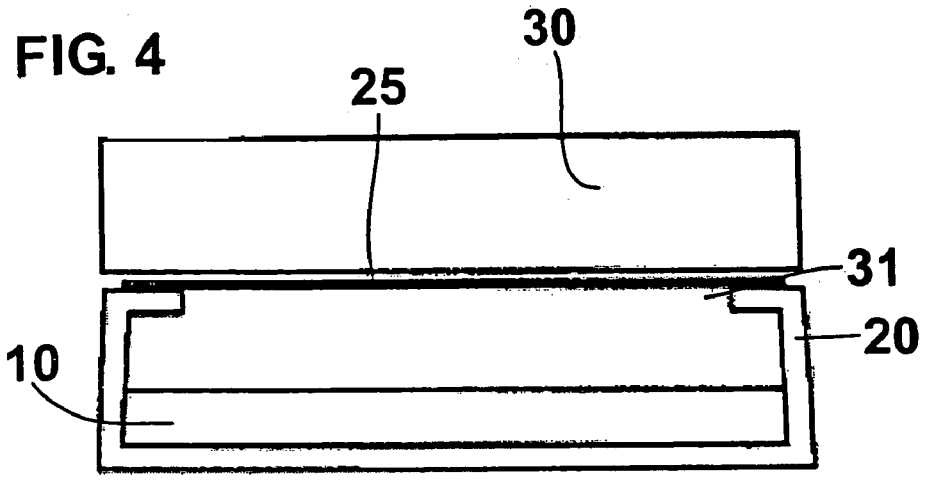
FIG. 4 shows a section through a microwave oven cleaner device including a dispenser with a cut through membrane seal and an integral clean-up sponge.

FIG. 4 shows a sponge 30 attached to the open face 31 of disposable dispenser 20. A cut through membrane 25 lies between sponge 30 and disposable dispenser 20. The product may be opened with a fork or knife plunged into sponge 30 and through membrane 25. This allows the sponge 30 to be wetted with solution 10 that may be volatile, such as ammonia, yet stored. The dispenser 20 may be shaped as a handle. A heavy surfactant can be used in the solution 10 in this embodiment.

The dispenser 20 with membrane seal 25 maintains solution 10 until time of use. Once the seal 25 is pierced and the solution 10 moistens the sponge 30, the apparatus is placed into the microwave oven and activated by running the oven. The vapor phase has now started. During this phase, a portion of solution 10 will vaporize and leave the sponge 30. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by holding the dispenser 20 and wiping down the interior surfaces of the oven with attached sponge 30.

Figure 5A:
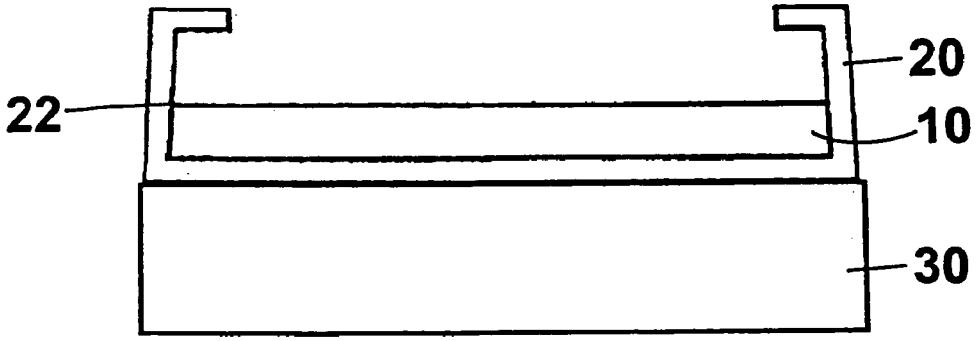
FIG. 5A shows a section through a microwave oven cleaner device made of a dispenser, solution, sponge and fill-line.

FIG. 5A shows a dispenser 20 with solution 10 and attached sponge 30. Such dispenser could be filled with solution 10 at time of use. A fill line 22 is used to define the preferred volume of solution 10 to be added. The attached sponge 30 is optional.

At time of use, the dispenser 20 is occupied with solution 10 at a preferred volume marked by the fill line 22: The apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the surfaces of the oven with sponge 30, cloth, paper towel, shammy or similar item.

Figure 5B:
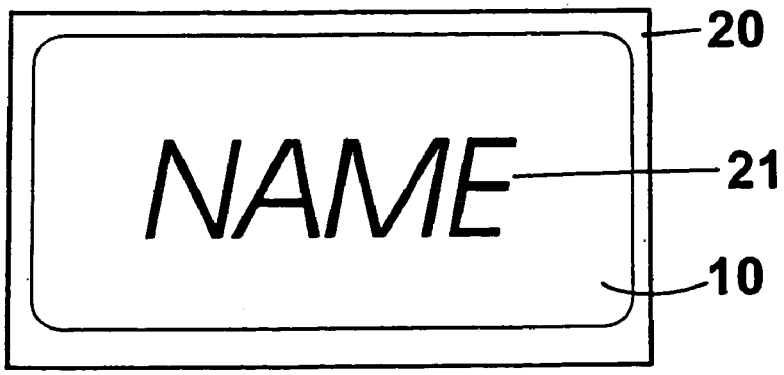
FIG. 5B shows the perspective of looking down into a microwave oven cleaner device of FIG. 5A.

FIG. 5B shows the same device as in FIG. 5A; however, this view is that from above looking down into a dispenser 20 with solution 10. From this perspective, an insignia 21 is noticeable.

Figure 6A:
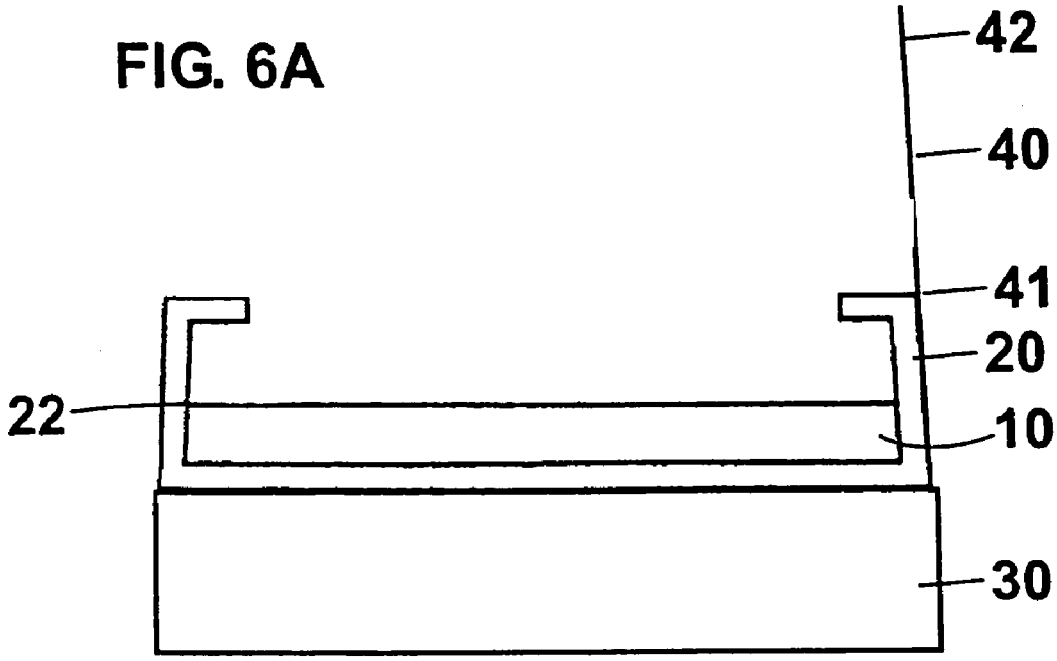
FIG. 6A shows a section through a microwave oven cleaner device made of a dispenser, solution, sponge, fill line and attached bottle hanger.

FIG. 6A shows solution 10 in a disposable dispenser 20 with sponge 30 and an attached bottle hanger 40. The bottle hanger 40 is composed of a fold or perforation 41 and a hole 42 to place over the top of a bottle when stored or distributed for resale. The bottle hanger 40 may be torn off from dispenser 20 via perforated fold 41 without affecting performance of the device. A fill line 22 is used to define the preferred volume of solution 10 to be added. The attached sponge 30 is optional.

At time of use, the dispenser 20 is occupied with solution 10 at a preferred volume marked by the fill line 22. The apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the interior surfaces of the oven with sponge 30, cloth, paper towel or similar item.

Figure 6B:
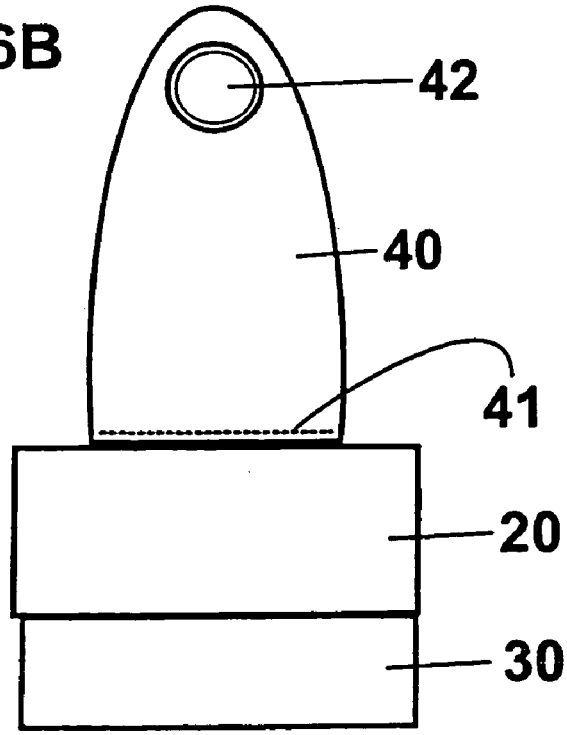
FIG. 6B shows a side-view of a microwave oven cleaner device of FIG. 6A

FIG. 6B shows the same device of FIG. 6A turned by a 90-degree perspective to one side. Solution 10 is in a disposable dispenser 20 with an attached bottle hanger 40. Bottle hanger 40 is composed of an optional fold or perforation 41 and a hole 42 to place over the top of a bottle.

While the principles of the invention have been made clear in illustrative embodiments, there will be immediately obvious to those skilled in the art, many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits of the true spirit and scope of the invention.

What is claimed is:

1. An apparatus for cleaning a microwave oven interior, comprising:

a wiping article for effecting a cleaning process;

a cleaning solution comprising water and a fragrance; and an enclosure at least partially enclosing the cleaning solution and the wiping article, wherein the enclosure comprises a seal that upon severing at least a portion of the seal, the cleaning solution is enabled to be dispersed into the microwave oven interior.

2. The apparatus of claim 1, wherein the wiping article is selected from the group consisting of a sponge, a cloth, a soft towel, a paper towel, a shammy and combinations thereof.

3. The apparatus of claim 2, wherein the enclosure comprises at least one material selected from the group consisting of plastic, paper, cardboard, microwave-safe materials and combinations thereof.

4. The apparatus of claim 3, wherein the cleaning solution further comprises at least one component selected from the group consisting of a surfactant, an emulsifier, an antibacterial agent and combinations thereof.

5. The apparatus of claim 4, wherein the at least one component is a surfactant and the enclosure comprises plastic.

6. The apparatus of claim 5, wherein the fragrance contains a scent selected from the group consisting of lemon, citrus and pine.

7. The apparatus of claim 4, wherein the cleaning solution provides a heated cleaning liquid and a cleaning vapor upon being heated by a microwave oven.

8. The apparatus of claim 1, wherein the enclosure comprises a plastic wrap, the wiping article is a soft towel and the cleaning solution further comprises a surfactant.

9. An apparatus for cleaning a microwave oven interior, comprising:

a cleaning liquid comprising water and a fragrance for forming a cleaning vapor;

an enclosure at least partially enclosing the cleaning liquid, wherein the enclosure contains a breakable seal to enable dispersion of the cleaning vapor; and a wiping article for effecting a cleaning process.

10. The apparatus of claim 9, wherein the wiping article is selected from the group consisting of a sponge, a cloth, a soft towel, a paper towel, a shammy and combinations thereof.

11. The apparatus of claim 10, wherein the enclosure is at least partially enclosing the wiping article and the enclosure comprises at least one material selected from the group consisting of plastic, paper, cardboard, microwave-safe materials and combinations thereof.

12. The apparatus of claim 11, wherein the enclosure comprises a plastic wrap, the wiping article is a soft towel and the cleaning liquid further comprises a surfactant.

13. The apparatus of claim 9, wherein the cleaning liquid further comprises at least one component selected from the group consisting of a surfactant, an emulsifier, an antibacterial agent and combinations thereof.

14. The apparatus of claim 13, wherein the at least one component is a surfactant and the enclosure comprises plastic.

15. The apparatus of claim 14, wherein the fragrance contains a scent selected from the group consisting of lemon, citrus and pine.

16. A method for cleaning an interior surface of a microwave oven, comprising:

placing a cleaning apparatus in the microwave oven, wherein the cleaning apparatus comprises a wiping article for effecting a cleaning process and an aqueous cleaning solution at least partially surrounded by an enclosure;

heating the cleaning apparatus for a first time period to evaporate at least a portion of the aqueous cleaning solution while forming and emitting a vapor;

cooling the cleaning apparatus for a second time period to hydrate a residue adhered on the interior surface of the microwave oven; and removing the residue from the interior surface with the wiping article.

17. The method of claim 16, wherein the wiping article is selected from the group consisting of a sponge, a cloth, a soft towel, a paper towel, a shammy and combinations thereof.

18. The method of claim 17, wherein the aqueous cleaning solution comprises a fragrance and at least one component selected from the group consisting of a surfactant, an emulsifier, an antibacterial agent and combinations thereof.

19. The method of claim 18, wherein the at least one component is a surfactant and the enclosure comprises plastic.

20. The method of claim 19, wherein the fragrance contains a scent selected from the group consisting of lemon, citrus and pine.

21. The method of claim 18, wherein the second time period is about 5 minutes.

22. The method of claim 16, wherein the enclosure comprises a plastic wrap, the wiping article is a soft towel and the aqueous cleaning solution comprises a fragrance and a surfactant.

23. A microwave-safe apparatus for cleaning an interior surface of a microwave oven, comprising:

a plastic-containing wrap disposed at least partially around a wiping article moistened with an aqueous surfactant solution compatible with food preparation and comprising a fragrance, wherein the plastic-containing wrap contains a breakable seal to enable dispersion of a cleaning vapor.

24. A microwave-safe apparatus for cleaning an interior surface of a microwave oven, comprising:

a cleaning solution for forming a cleaning vapor, wherein the cleaning solution contains at least water, a surfactant and a fragrance;

a sealed enclosure containing the cleaning solution and a breakable seal for releasing the cleaning vapor; and a wiping article moistened with the cleaning solution and at least partially surrounded by the sealed enclosure.

25. A kit for cleaning an interior surface of a microwave oven, comprising:

a cleaning apparatus comprising:

an enclosure disposed at least partially around a wiping article moistened with a cleaning solution containing at least water, a surfactant and a fragrance, wherein the enclosure contains a breakable seal for releasing a cleaning vapor; and a set of directions comprising instructions to:

place the cleaning apparatus into a microwave oven;

heat the cleaning apparatus by operating the microwave oven for a first time period to form the cleaning vapor from the cleaning solution;

cool the cleaning apparatus by ceasing to operate the microwave oven for a second time period while maintaining the microwave oven closed and loosening a residue adhered onto an interior surface of the microwave oven; and remove the residue from the interior surface with the wiping article.

26. The kit of claim 25, wherein the enclosure comprises a plastic wrap and the second time period lasts for about 5 minutes.

27. The kit of claim 25, wherein the breakable seal is positioned on a top surface of the enclosure and the set of directions further instruct to place the cleaning apparatus into the microwave oven with the top surface of the enclosure facing up.

28. A microwave-safe apparatus for cleaning an interior surface of a microwave oven, comprising:

an enclosure containing a cleaning solution compatible with food preparation, wherein the cleaning solution contains at least water, a surfactant and a fragrance;

a wiping article for effecting a cleaning process and at least partially surrounded by the enclosure; and a sealed surface of the enclosure that is severable to enable dispersion of a cleaning vapor.

29. The apparatus of claim 28, wherein the sealed surface is disposed on a top side of the enclosure.

* * * * *